United States Patent [19]

Jaquith

[11] 4,286,494

[45] Sep. 1, 1981

[54] SELF ADJUSTING BRIDGE WITH LOCKING PIN FOR ALL VIOL INSTRUMENTS

[75] Inventor: Douglas Jaquith, Yakima, Wash.

[73] Assignee: Hope Jaquith, Laguna Niguel, Calif.

[21] Appl. No.: 150,971

[22] Filed: May 19, 1980

[51] Int. Cl.[3] ..... G10D 3/04

[52] U.S. Cl. ..... 84/309; 84/274

[58] Field of Search ..... 84/274, 298, 299, 307, 84/309–311

[56] References Cited

U.S. PATENT DOCUMENTS

| | | | |
|---|---|---|---|
| 1,438,386 | 12/1922 | Lucas | 84/309 |
| 1,707,069 | 3/1929 | Wendell | 84/309 |
| 1,737,338 | 11/1929 | Schroder | 84/309 |
| 3,134,287 | 5/1964 | Jaquith | 84/309 |

*Primary Examiner*—Lawrence R. Franklin

*Attorney, Agent, or Firm*—Blakely, Sokoloff, Taylor & Zafman

[57] ABSTRACT

An improvement to a prior art bridge for a viol instrument is disclosed. The prior art bridge included pivotal support feet permitting the support feet to align themselves with the contour of the instrument. The present invention provides locking means which prevents these pivotally mounted support feet from lateral movement (in the direction of the strings).

6 Claims, 4 Drawing Figures

SELF ADJUSTING BRIDGE WITH LOCKING PIN FOR ALL VIOL INSTRUMENTS

BACKGROUND OF THE INVENTION

1. Field of the Invention

The invention relates to the field of violin bridges, U.S. Class 84/309.

2. Prior Art

Bridges are used on viol instruments, such as violins, violas, cellos, and bass viols to transfer sound from the strings to the sound box (body) of the instrument. For proper transfer of this sound and also to prevent movement of the bridge, the bridge support feet should be contoured to match the contour of the instrument. This, however, requires that each bridge be contoured to the body of a specific instrument.

In U.S. Pat. No. 3,134,287, a self-adjusting bridge for viol instruments is described. The support feet of this bridge are pivotally coupled to the main body (standard) of the bridge. Rounded tongues on the supports cooperatively engage openings defined by the standard. When the bridge is placed on an instrument, the support feet automatically move (pivot) to match the contour of the instrument.

One difficulty with this prior art bridge is that in some cases the main body of the bridge moves laterally relative to the support feet, (that is, in the direction of the strings). This occurs because the frictional forces relied upon to maintain the coupling of the support feet in the openings of the standard are insufficient.

As will be described, the present invention provides an improvement to this prior art bridge by eliminating this undesirable moving between the standard of the bridge and its support feet.

SUMMARY OF THE INVENTION

An improvement is described to a self-adjusting bridge for a musical instrument of the viol class. The bridge includes a substantially flat-sided and upright standard having a support foot at each end thereof. The support feet include pivot means which connect each of them to the standard at mating surfaces. This enables the lower surface of each of the support feet to conform to the curvature of the body of the instrument. The improvement to this bridge provided by the present invention includes a pair of slots defined within the lower surfaces of the standard in the region of the pivot means. Each of these support feet include an aperture which extends through the support foot into communication with one of the slots. A pin is inserted through each of the apertures into cooperative engagement with the slots. This permits pivoting between the standard and the support feet, but restricts lateral movement. Thus, with the improvement of the present invention the support feet are prevented from moving laterally with respect to the standard.

DETAILED DESCRIPTION OF THE INVENTION

Figure 1:
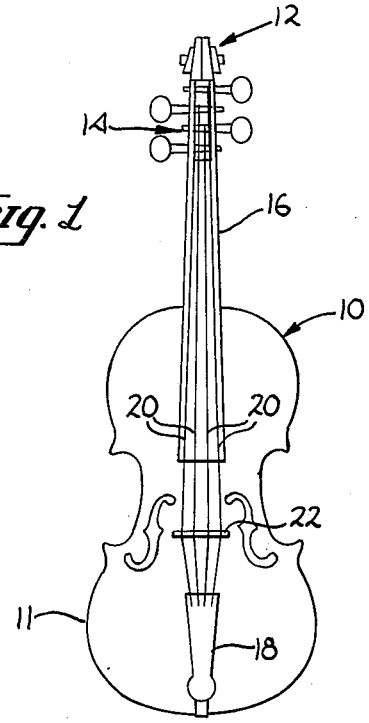
FIG. 1 is a front view of a violin.

Referring to FIG. 1, a violin 10 is illustrated. The components of a violin are generally the body 11, a scroll 12, a peg box 14, a finger board 16, and a tail piece 18. The strings 20, extend between the tail piece at one end of a violin and the pegs mounted in the peg box at the other end. These strings are spaced from the body of a violin between the tail piece and fingerboard by a bridge 22.

Figure 2:
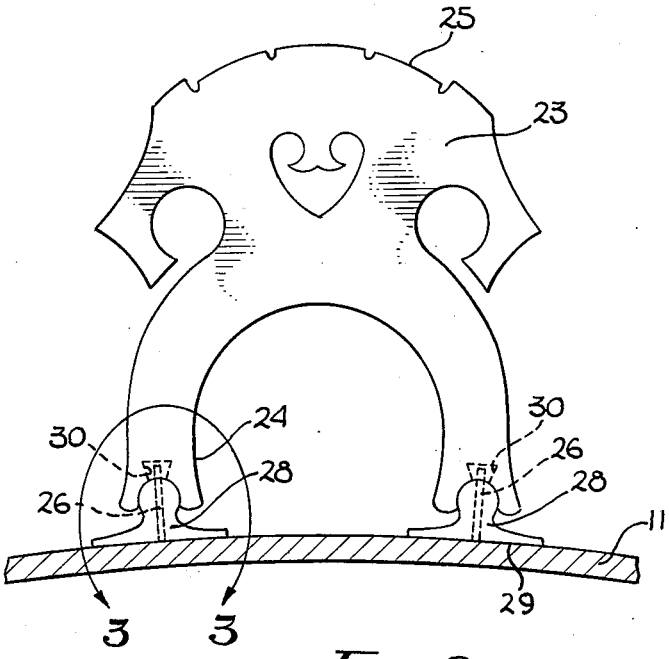
FIG. 2 is a front view of the face of a bridge which includes the improvement of the present invention.

Consider now the construction of the bridge 22 shown in FIG. 2. The bridge is comprised of a standard 23 which is generally a flat member ordinarily made from maple wood or other woods. The arcuate top edge 25 includes slots which receive the strings 20. A pair of support feet 28 are disposed at the base of the standard. The lower surface of each support foot engages the body 11 of the violin 10; the upper part of each support foot pivotally engages the standard.

Figure 3:
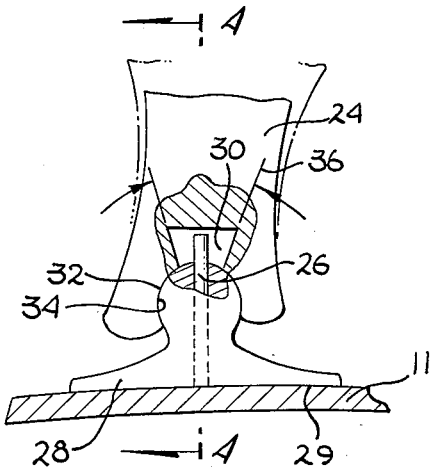
FIG. 3 is an enlarged view with a cutaway section of one support foot of the bridge of FIG. 2 taken generally through section line 3—3 of FIG. 2.

A more detailed depiction of one support foot and the coupling to the standard 24 is shown in FIG. 3. Each support foot consists of an elongated bottom surface 29, and a cylindrical upper surface 34. The upper surface 34 is pivotally connected to the base of the standard 24. In general, the support foot 28 is coupled to the base 24 by sliding it into an opening (surface 34) which is defined by the standard. The support foot is slid into place so that the support foot and the standard are coplanar.

Figure 4:
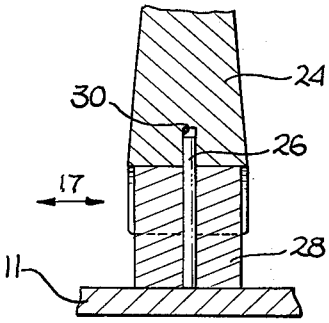
FIG. 4 is a cross-sectional side view of the portion of the bridge and support foot of FIG. 3 taken generally through section line 4—4 of FIG. 3.

With this arrangement, movement between the support foot and standard can occur in the direction indicated by arrow 17 of FIG. 4. The friction presented by the mating surfaces 32 and 34 retards lateral separation, but does not entirely prevent this separation from occurring. This undesirable lateral separation is effectively eliminated by the improvement of this invention as will be described in the following paragraphs.

Referring now to FIGS. 2, 3 and 4, the present invention includes the use of a bore or aperture which extends from the lower surface of each support foot 28 through its upper surface 34. Each aperture is in communication with a groove or slot 30 defined within the lower surface 32 of the standard base 24. A pin 26 is inserted into the aperture 27 and extends into the slot 30.

The dimensions of the slots 30 are such to permit pivotal action between the support feet and the standard while preventing lateral movement. More specifically, as may be seen in FIG. 4, the slots 30 are of a dimension approximately equal to that of pins 26 in the direction indicated by arrow 17. This close fit between the pins and the grooves in this direction prevents lateral movement. On the other hand, as may best be seen in FIG. 3, the slots 30 in the direction of the flat plane of the standard is relatively large (see dimension 36 of FIG. 3) when compared to the diameter or dimension of the pin. This permits the pivoting of the support feet 28.

In the presently preferred embodiment, a hole is drilled through the wooden support feet 28 in an ordinary manner. The slots 30 are cut with an ordinary wood-cutting tool. Then, either a wooden pin, metal pin or pin formed from other materials is inserted from the lower surface of the support feet 28 into the slots 30. Glue or other adhesive may be used to retain the pin within the apertures, or the pin may be press fit into the aperture. The ends of the pins opposite slots 30 are made flush with the lower surfaces of the support feet 28 to prevent them from damaging the body 11 of the instrument.

The above paragraphs describe the improvement for the bass viol bridge. Similar locking pins will be installed through the support feet into the standard in the cello bridge, and similar locking pins will be installed for the violin and viola bridges.

Thus, an improvement to a prior art bridge which includes pivoting support feet has been described. The improvement comprises the use of locking pins, which prevent lateral movement between the standard and support feet.

I claim:

1. In a self-adjusting bridge for a musical instrument of the viol class in which a substantially flat sided and upright standard having a support foot at each end thereof and pivot means connecting each of said support feet to said standard at mating surfaces for the purpose of enabling the lower surface of each of said support feet to conform to the curvature of the body of said instrument, an improvement comprising:

(a) A pair of slots defined by the lower surface of said standard, each of said slots disposed in the region of said pivot means;

(b) each of said support feet including an aperture extending through said support foot into communication with one of said slots;

(c) a pair of pins, each of said pins extending through one of said apertures into cooperative engagement with one of said slots so as to permit pivoting between said standard and one of said support feet, but restricting lateral movement between said standard and said one of said support feet;

whereby said support feet are each pivotally connected to said standard in a manner preventing the separation of said support feet from said standard by movement parallel to the plane of said standard.

2. The improvement defined by claim 1 wherein said pins are press fit in said apertures.

3. The improvement defined by claim 1 wherein said pins are wooden member.

4. In a self-adjusting bridge for a musical instrument of the viol class having a generally flat standard, said standard having a base, a first support foot at one end of said base and a second support foot at the other end of said base, said first support foot and said second support foot each pivotally connected to said base, an improvement comprising:

(a) a first slot disposed in said one end of said base;

(b) a second slot disposed in said other end of said base;

(c) said first support foot including a first aperture extending from the lower surface of said first support foot to the upper surface of said first support foot;

(d) said second support foot including a second aperture extending from the lower surface of said second support foot to the upper surface of said second support foot;

(e) a first pin engaging said first aperture and extending into said first slot;

(f) a second pin engaging said second aperture and extending into said second slot; whereby each of said pivotal connections is unhampered and lateral separation of said first support foot and said second support foot from said standard is inhibited.

5. The improvement defined by claim 4 wherein the dimensions of said slots in the direction transverse to said flat standard is approximately equal to the dimension of said pins.

6. The improvement defined by claim 5 wherein the dimensions of said slots parallel to said flat standard is substantially larger than said dimension of the said pins.

* * * * *